US008955675B2

(12) United States Patent
Olsen

(10) Patent No.: US 8,955,675 B2
(45) Date of Patent: Feb. 17, 2015

(54) CONTAINER CARRIER

(71) Applicant: Robert C. Olsen, Medinah, IL (US)

(72) Inventor: Robert C. Olsen, Medinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/801,671

(22) Filed: Mar. 13, 2013

(65) Prior Publication Data

US 2014/0001061 A1 Jan. 2, 2014

Related U.S. Application Data

(60) Provisional application No. 61/666,002, filed on Jun. 29, 2012.

(51) Int. Cl.
*B65D 75/00* (2006.01)
*B65D 71/50* (2006.01)

(52) U.S. Cl.
CPC ..... *B65D 75/00* (2013.01); *B65D 71/504* (2013.01)
USPC ..... 206/150

(58) Field of Classification Search
USPC ..... 206/149–153, 427; 294/87.2
See application file for complete search history.

(56) References Cited

U.S. PATENT DOCUMENTS

| | | | | |
|---|---|---|---|---|
| 4,513,860 | A * | 4/1985 | Rhoads | 206/150 |
| 5,487,465 | A * | 1/1996 | Broskow | 206/150 |
| 5,642,808 | A * | 7/1997 | Marco et al. | 206/150 |
| 5,806,667 | A | 9/1998 | Marco | |
| 6,148,994 | A * | 11/2000 | Olsen | 206/150 |
| 6,969,098 | B2 * | 11/2005 | Olsen | 294/87.2 |
| 7,387,201 | B2 * | 6/2008 | Olsen et al. | 206/150 |
| 7,510,075 | B2 * | 3/2009 | Olsen et al. | 206/150 |
| 8,545,375 | B2 * | 10/2013 | Marco et al. | 493/226 |
| 2004/0004365 | A1 * | 1/2004 | Olsen | 294/87.2 |
| 2005/0241963 | A1 * | 11/2005 | Slomski | 206/150 |
| 2006/0196782 | A1 * | 9/2006 | Olsen et al. | 206/150 |

FOREIGN PATENT DOCUMENTS

WO WO 2006/114769 A1 11/2006

* cited by examiner

*Primary Examiner* — Luan K Bui
(74) *Attorney, Agent, or Firm* — Pauley Peterson & Erickson

(57) ABSTRACT

A flexible carrier for carrying a plurality of containers within a plurality of corresponding container receiving apertures that includes at least two rows of container receiving apertures wherein each container receiving aperture is wider than an adjacent container receiving aperture from a center to outer edges of the carrier.

19 Claims, 3 Drawing Sheets

CONTAINER CARRIER

CROSS REFERENCE TO RELATED APPLICATION

This application claims the benefit of U.S. Provisional Application No. 61/666,002, filed 29 Jun. 2012.

FIELD OF THE INVENTION

This invention relates to a flexible carrier for carrying a plurality of containers such as cans or bottles.

DESCRIPTION OF PRIOR ART

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures that each engage a corresponding container may be used to unitize groups of four, six, eight, twelve or other suitable groups of containers into a convenient multipackage. Flexible ring carriers may include a handle that extend upwardly from the carrier to enable a consumer to carry the package.

Flexible ring carriers are typically fed across a rotating applicating drum having a plurality of jaws that open the individual container receiving apertures to stretch them around a respective container and then release them onto the container. In this manner, a package of multiple containers is formed.

There is some difficulty associated with packaging longer carriers having upwardly extending handles, called "top-lift carriers," because of the need to open all container receiving apertures approximately the same amount and at generally the same time within the applicating machine. At high speeds this becomes troublesome because center pairs of container receiving apertures open up easily as required because of the proximate location of vertical struts in the top-lift handle. However, the next outer container receiving apertures open up or spread out laterally slightly less and the far outer container receiving apertures open much less as the carrier is fed onto the applicating drum.

One way to combat this difficulty is to extend a width of the top-lift handle outward. However, this results in a package having a sloppy appearance because the handle tends to curl or snake, resulting in a handle that is not aesthetically pleasing or graspable by the consumer. As such, a need arises for a carrier aperture configuration that permits consistent aperture opening and permits high speed application yet results in an aesthetically pleasing package to the consumer

SUMMARY OF THE INVENTION

The present invention is directed to a flexible carrier for packaging containers that includes an arrangement of container receiving apertures that are wider and longer as they progress from a center area of the carrier to outer edges of the carrier.

According to preferred embodiments of this invention, each flexible carrier preferably includes two rows of container receiving apertures, each for receiving a container, to form a package. In addition, a handle is preferably connected between the rows of container receiving apertures. A plurality of struts may connect the handle with the flexible sheet between the rows of container receiving apertures, preferably between a centerline of the flexible sheet and the handle.

The resulting carrier is configured to permit each container receiving aperture to open up laterally the same amount during the carrier feeding onto an applicator drum, allowing high speed carrier feed and reliable application and, ultimately, an improved integrity of the resulting package.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
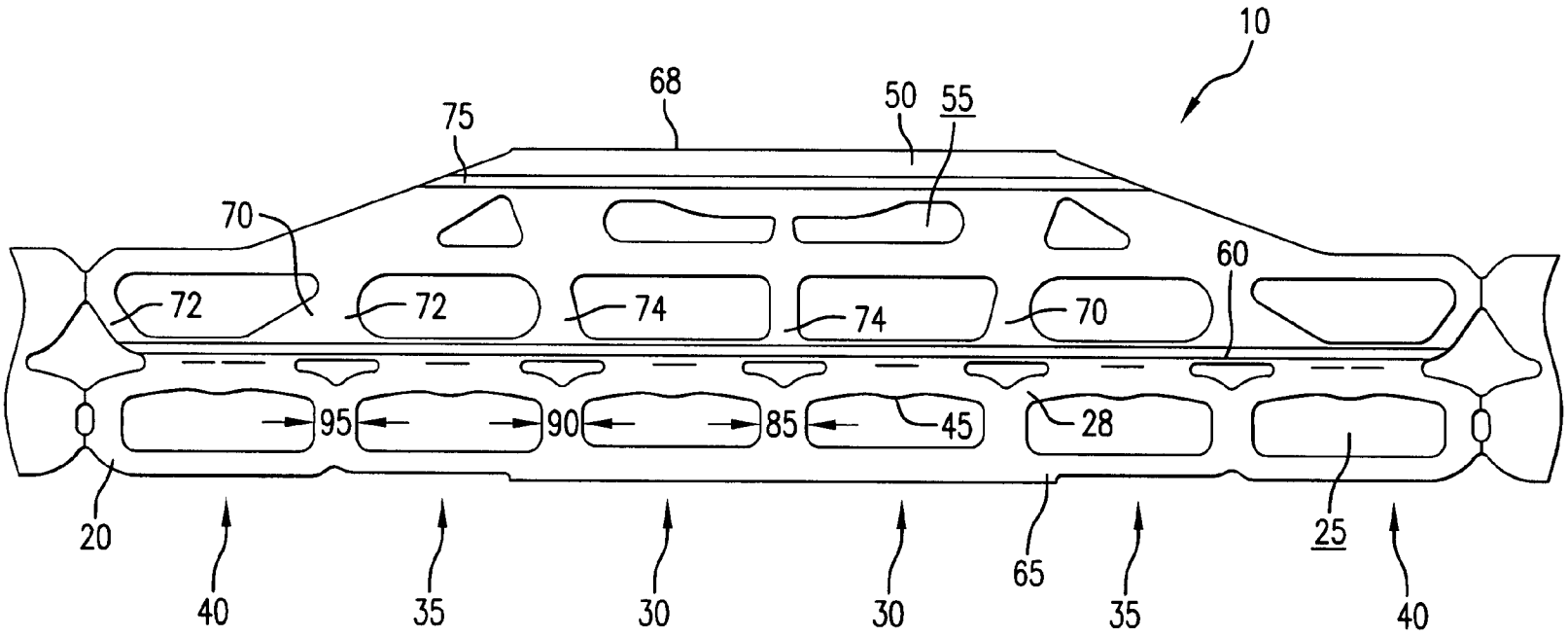
FIG. 1 is a side elevational view of a flexible carrier according to one preferred embodiment of this invention.
Figure 2:
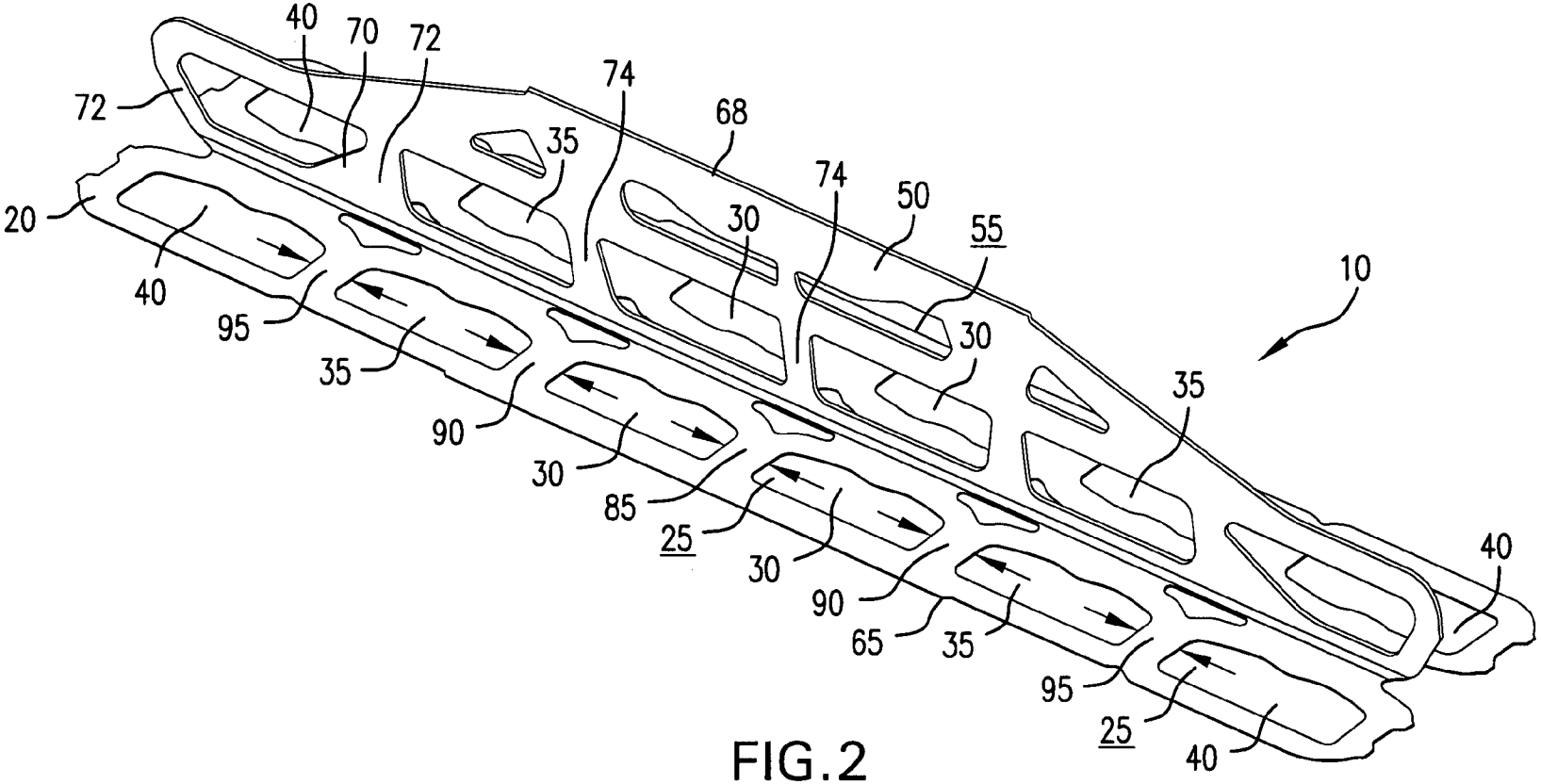
FIG. 2 is a side perspective view of the flexible carrier of FIG. 1 in an opened position.
Figure 3:
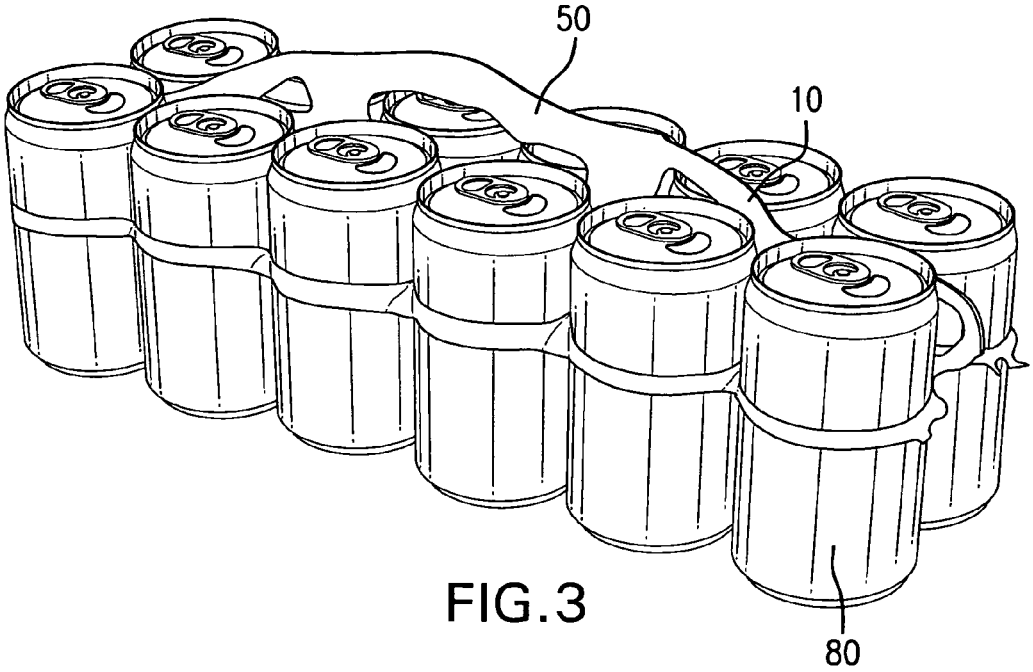
FIG. 3 is a side perspective view of a package of containers according to one preferred embodiment of this invention.

FIGS. 1-3 show flexible carrier 10 for unitizing eight or more containers and a resulting unitized package. Although FIGS. 1-3 illustrate various structures for flexible carrier 10 of the invention, the illustrations are exemplary, and the invention is not limited to the flexible carriers 10 or packages shown. For example, flexible carrier 10 may be alternatively configured and used to unitize ten, fourteen or any other desired number of containers 80.

Containers 80, such as those shown in FIG. 3, are preferably cans, however, bottles or any other commonly unitized container may be used with flexible carrier 10 according to this invention. The containers are preferably, though not necessarily, like-sized within a single flexible carrier 10.

Each flexible carrier 10 preferably includes one or more layers of flexible sheet 20 having a width and length defining therein a plurality of container receiving apertures 25, each for receiving a container 80. The plurality of container receiving apertures 25 are preferably arranged in longitudinal rows and longitudinal ranks so as to form an array of container receiving apertures 25, such as two rows by six ranks for a twelve container multipackage as shown in FIGS. 1 and 2. Container receiving apertures 25 are preferably elongated in a longitudinal direction of flexible carrier 10.

According to one preferred embodiment of this invention, such as shown in FIGS. 1 and 2, two layers of flexible sheet 20 are connected along a longitudinally extending centerline 60. Centerline 60 as used herein generally describes a segment between rows of container receiving apertures 25 and/or between layers of flexible sheet 20. According to one preferred embodiment of this invention, centerline 60 comprises a weld that joins the two layers of flexible sheet 20. The two layers of flexible sheet 20 may be coextruded, welded, or otherwise joined together to create flexible carrier 10. A "weld" as used in the specification and claims may be defined as a hot weld, cold weld, lamination or any other manner of connection that joins two sheets of material known to those having ordinary skill in the art.

As shown in FIGS. 1-3, a row of container receiving apertures 25 is preferably formed on each side of centerline 60 and/or in each layer of the two layers of flexible sheet 20. As such, one row of container receiving apertures 25 is preferably formed along each side of the centerline 60. Accordingly, twelve container receiving apertures 25 are formed in flexible carrier 10 shown in FIG. 1, i.e. two overlapping rows of six container receiving apertures 25 each. Container receiving apertures 25 are preferably formed in a geometry that results in a tight unitization of containers 80 without excess play and/or sliding between and among containers 80 and flexible carrier 10. Such a result is difficult when carrier 10 is elongated for eight or more containers 80 as described herein.

As described above, container carrier 10 according to a preferred embodiment of the invention includes a series of interconnecting oblique webs 28 that define the plurality of container receiving apertures 25. Webs 28 are stretchable around container 80 during application and recoverable around container 80 following application.

As described above, the plurality of container receiving apertures 25 are preferably arranged in transverse pairs. As shown in FIGS. 1 and 2, at least two rows forming a plurality of container receiving aperture pairs extend across carrier 10. FIG. 1 shows carrier 10 in a flat state and FIG. 2 shows carrier 10 in an opened state where each adjacent pair may be clearly shown. In particular, carrier 10 preferably includes center pairs 30 in a center area of carrier 10. As shown in FIG. 1, two center pairs 30 are formed central within the six pairs of container receiving apertures 25. Intermediate pairs 35 are formed outward of center pairs 30. Finally, outer pairs 40 are formed at each outer edge of carrier 10, outward of intermediate pairs 35.

According to a preferred embodiment, each container receiving aperture 25 in the outer pairs 40 is wider (measured along a transverse axis of the carrier) than each container receiving aperture 25 in intermediate pairs 35 which is wider than each container receiving aperture in center pairs 30. In one embodiment, each successive pair is approximately 0.040" wider than the next.

Likewise, as shown in FIGS. 1 and 2, each container receiving aperture 25 in the outer pairs 40 is longer than each container receiving aperture 25 in the intermediate pairs 35 which is longer than each container receiving aperture 25 in the center pairs 30. For example, center pairs 30 may include a length (measured along a longitudinal axis of the carrier) of approximately 1.948", intermediate pairs 35 may include a length approximately 0.050" longer than the center pairs 30 and outer pairs 40 may include a length approximately 0.150" longer than the center pairs 30. As a result, the container receiving apertures 25 are progressively longer than an adjacent container receiving aperture 25 from a center to outer edges of the carrier 10.

A nub 45 preferably extends along an inner edge of each container receiving aperture 25. In this manner, containers 80 are preferably held in a tighter more unitized manner within an assembled package 100 of containers 80.

According to one preferred embodiment shown in FIG. 1, a lip 65 is formed along each longitudinal periphery of the carrier 10. Preferably, the lip 65 is formed in an area of the center pairs 30 of container receiving apertures 25. A corresponding ridge 68 is preferably formed along handle 50 and, during the manufacturing process, several adjacent lanes of carriers 10 may be connected between lip 65 and ridge 68.

As shown in FIG. 1, a first distance 85 between center pairs 30 of container receiving apertures 25 is longer than a second distance 90 between center pairs 30 and intermediate pairs 35 of container receiving apertures 25. Further, a third distance 95 between intermediate pairs 35 of container receiving apertures and outer pairs 40 of container receiving apertures is shorter than the second distance 90.

As shown in FIGS. 1-3, according to one preferred embodiment of this invention, handle 50 is formed along the centerline 60 between the two rows of container receiving apertures 25 and, following application to containers as shown in FIG. 2, in a separate plane from the two rows of container receiving apertures 25. Specifically, as shown in FIG. 1, handle 50 is connected along a side of the row of container receiving apertures 25, and is preferably connected with respect to centerline 60, such as a weld. Handle 50 may be integrally formed with flexible sheet 20 or may be separately formed and attached relative to flexible sheet 20.

Handle 50 may comprise one or more elongated apertures 55 positioned along the outer periphery of handle 50 or may comprise a similar configuration that provides an ample area for a consumer to grasp by inserting his hand through and still maintain the purpose and integrity of package 100.

As best shown in FIGS. 1 and 2, a plurality of struts 70 connect handle 50 with the rows of container receiving apertures 25, preferably between centerline 60 and handle 50. In the two layer of flexible sheet 20 embodiment of the subject invention, struts 70 are preferably formed in both layers of flexible sheet 20 and one or more handle welds 75 may be positioned longitudinally across handle 50. The plurality of struts 70 may comprise inner struts 74 located across internal portions of flexible carrier 10 and outer struts 72 located across a periphery of flexible carrier 10.

As shown in FIG. 3, package 100 resulting from flexible carrier 10 includes a plurality of unitized containers 80. Flexible carriers 10 are generally applied to containers 80 by stretching flexible sheet 20 surrounding container receiving apertures 25 around container 80, and requiring the stretched carrier 10 to recover, thereby providing a tight engagement.

The ability of the individual container receiving apertures 25 to open consistently up and feed onto applicator jaws and, subsequently, engage a respective container during application is particularly important. During these moments, carrier 10 is fanned out at centerline 60 and divided from a trailing, adjacent carrier and then turned and diverted, all at speeds of 2000+ containers per minute without twisting or falling over.

As a result of the described configuration in one preferred embodiment of this invention, two layers of flexible sheet 20 joined with the longitudinally extending centerline 60 include a row of container receiving apertures 25 formed in each layer of the two layers of flexible sheet 20. One row of container receiving apertures 25 is formed on each side of centerline 60 resulting in flexible carrier 10 fanning out at centerline 60 to permit a generally flat plane of engagement within which containers 80 are inserted. Handle 50 preferably extends in a different plane from flexible sheet 20 in this configuration at application, as best shown in FIGS. 2 and 3. In this manner, each row of container receiving apertures 25 engages a respective row of containers 80 to form package 100.

Handle 50 suitable for manual grasping preferably extends from an approximate middle of flexible sheet 20. In package 100 according to one preferred embodiment of this invention, handle 50 preferably extends upwardly from centerline 60 and between each row of container receiving apertures 25. Handle struts 70 permit proper separation between centerline 60 and handle 50 to permit a comfortable grasping area within package 100. As such, package 100 may be carried by manually grasping handle 50 extending upwardly from package 100.

A method of packaging multiple containers 80 with carrier 10 to form a unitized packages includes providing containers 80 to an applicating machine (not shown). Such applicating machines typically include a rotating drum with a plurality of jaw pairs for engaging carrier 10. Carrier 10 is moved through the applicating machine and positioned over container 80. Carrier 10 is then released around each container 80 to form the unitized package.

While in the foregoing specification this invention has been described in relation to certain preferred embodiments thereof, and many details have been set forth for purpose of illustration, it will be apparent to those skilled in the art that flexible carrier 10 and package 100 are susceptible to additional embodiments and that certain of the details described herein can be varied considerably without departing from the basic principles of the invention.

The invention claimed is:

1. A carrier for unitizing a plurality of containers within a plurality of corresponding container receiving apertures, the carrier comprising:

at least two rows forming a plurality of container receiving aperture pairs extending from center pairs to intermediate pairs to outer pairs, wherein each container receiving aperture in the outer pairs is wider than each container receiving aperture in intermediate pairs which is wider than each container receiving aperture in center pairs.

2. The carrier of claim 1 wherein each container receiving aperture in the outer pairs is longer than each container receiving aperture in intermediate pairs which is longer than each container receiving aperture in center pairs.

3. The carrier of claim 1 further comprising a weld positioned between the rows of container receiving apertures.

4. The carrier of claim 3 further comprising a handle extending from the weld.

5. The carrier of claim 4 further comprising a plurality of struts formed between the handle and the weld.

6. The carrier of claim 1 further comprising a lip formed along each longitudinal periphery of the carrier, the lip formed in an area of the center pairs of container receiving apertures.

7. The carrier of claim 1 further comprising a nub extending along an inner edge of each container receiving aperture.

8. The carrier of claim 1 further comprising a first distance between center pairs of container receiving apertures which is longer than a second distance between center pairs and intermediate pairs of container receiving apertures.

9. The carrier of claim 1 further comprising a third distance between intermediate pairs of container receiving apertures and outer pairs of container receiving apertures which is shorter than the second distance.

10. A carrier for unitizing a plurality of containers within a plurality of corresponding container receiving apertures, the carrier comprising:

at least two rows of container receiving apertures wherein each container receiving aperture is wider and longer than an adjacent container receiving aperture from a center to outer edges of the carrier; and a weld positioned between the rows of container receiving apertures.

11. The carrier of claim 10 wherein a distance between each adjacent container receiving aperture is wider from the center to the outer edges of the carrier.

12. The carrier of claim 10 further comprising a handle extending from the weld.

13. The carrier of claim 12 further comprising a plurality of struts formed between the handle and the weld.

14. The carrier of claim 11 further comprising a lip formed along each longitudinal periphery of the carrier, the lip formed in an area of center pairs of container receiving apertures.

15. The carrier of claim 11 further comprising a nub extending along an inner edge of each container receiving aperture.

16. The carrier of claim 11 wherein the container receiving apertures art arranged in center pairs in a central area of the carrier, intermediate pairs outward of the center pairs, and outer pairs at outer edges of the carrier.

17. The carrier of claim 16 further comprising a first distance between center pairs of container receiving apertures which is longer than a second distance between center pairs and intermediate pairs of container receiving apertures.

18. The carrier of claim 17 further comprising a third distance between intermediate pairs of container receiving apertures and outer pairs of container receiving apertures which is shorter than the second distance.

19. A carrier for unitizing a plurality of containers within a plurality of corresponding container receiving apertures, the carrier comprising:

at least two rows of container receiving apertures wherein each container receiving aperture is wider and longer than an adjacent container receiving aperture from a center to outer edges of the carrier, wherein a distance between each adjacent container receiving aperture is wider from the center to the outer edges of the carrier.

* * * * *